United States Patent [19]

Harrison et al.

[11] 4,346,578

[45] Aug. 31, 1982

[54] EXTRUSION PRESS AND METHOD

[76] Inventors: Nelson K. Harrison; Dana B. Lamb, both of 6901 W. 30th St., Berwyn, Ill. 60402

[21] Appl. No.: 218,353

[22] Filed: Dec. 22, 1980

Related U.S. Application Data

[62] Division of Ser. No. 755,747, Dec. 30, 1976, Pat. No. 4,308,742.

[51] Int. Cl.[3] ..... B21C 23/21

[52] U.S. Cl. ..... 72/271; 72/253.1; 72/455

[58] Field of Search ..... 72/253.1, 257, 271, 72/273.5, 455, 456, 462; 100/214; 29/404

[56] References Cited

U.S. PATENT DOCUMENTS

| | | | |
|---|---|---|---|
| 1,251,430 | 12/1917 | Sherman | 100/214 |
| 1,636,057 | 7/1927 | Jones | 29/447 |
| 1,974,148 | 9/1934 | Byerlein | 29/404 |
| 2,675,125 | 4/1954 | Genders | 72/271 |
| 3,019,144 | 1/1962 | Murphy et al. | 72/257 |
| 3,216,233 | 11/1965 | Pischel | 72/257 |
| 3,919,878 | 11/1975 | Groos | 72/456 |
| 4,240,342 | 12/1980 | Delmer | 100/214 |

FOREIGN PATENT DOCUMENTS

| | | | |
|---|---|---|---|
| 1232804 | 1/1967 | Fed. Rep. of Germany | 72/462 |
| 1103990 | 11/1955 | France | 100/214 |
| 1309539 | 3/1973 | United Kingdom | 100/214 |

*Primary Examiner*—Lowell A. Larson
*Attorney, Agent, or Firm*—Morris Spector

[57] ABSTRACT

Known extrusion presses create elastic oscillations that result in chatter cracking when the metal being extruded is a high strain rate sensitive material. This invention removes that problem by placing the tie rods of the press in an initial pre-tension of a magnitude greater than the maximum tie rod stress that will be caused by the flow of metal through the extrusion die, and holding the thrust of the pre-tension by cast iron columns of such cross sectional area that the linear compression of the columns due to the thrust of that pre-tension is negligible.

11 Claims, 13 Drawing Figures

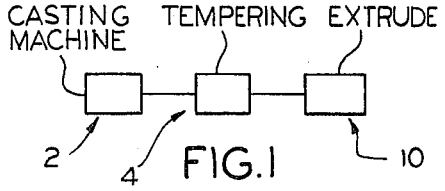
FIG.1
FIG.2
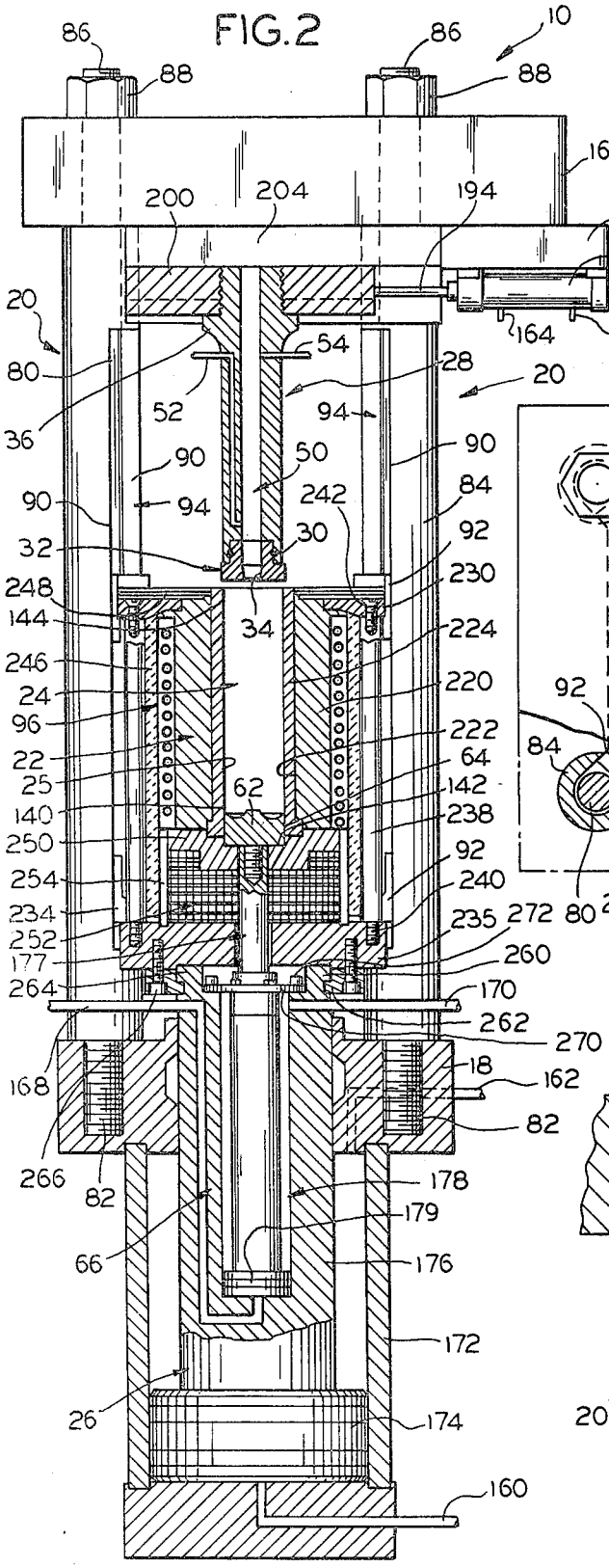
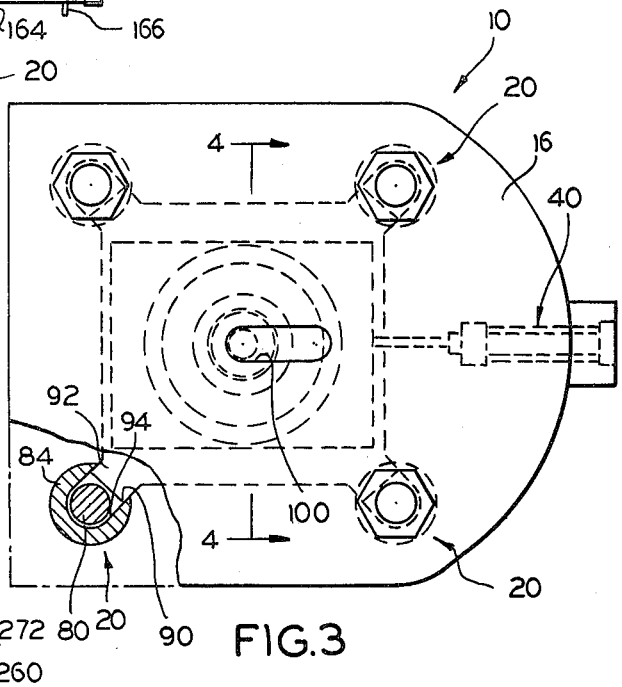
FIG.3
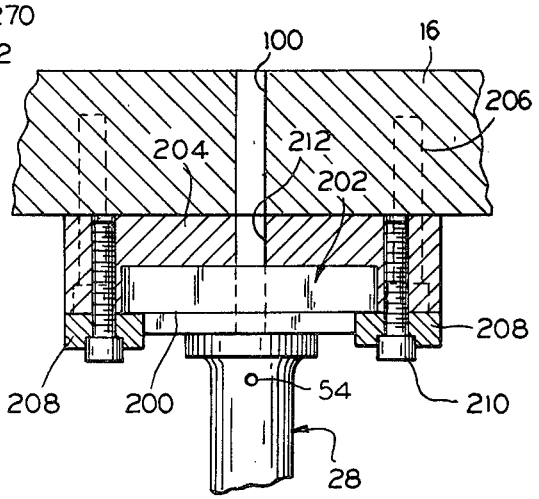
FIG. 4

EXTRUSION PRESS AND METHOD

This application is a division of our pending application for patent Ser. No. 755747 filed Dec. 30, 1976, now U.S. Pat. No. 4,308,742 granted Jan. 5, 1982.

Metal billets for extrusion to form solid or tubular bars are cast and cooled to their solidification temperature as quickly as possible to minimize grain growth, and are then cooled to their extrusion temperature in an evening oven and maintained at that temperature until they are to be placed in the extrusion press. This also assures attainment of a uniform temperature throughout the mass of the billet. The billet size is so chosen that the heat conduction from the inner molten mass of the billet during solidification will result in sufficiently quick solidification as to inhibit objectionable grain formation. We have found that for a cylindrical billet being cast in a water-cooled mold, a good maximum diameter is about 4.5 inches. The temperature of the billet at the time of extrusion should be as high as possible but below that at which any liquification of the extrusion metal can result from its flow thru the extrusion die. In the case of an alloy the temperature should be below the eutectic temperature of the particular alloy.

In order to maintain a uniformity in the extruded product as the extrusion continues, it is desirable that the temperature of the billet being extruded should be maintained constant throughout. It is one of the objects of this invention to obtain this result. This is accomplished in the press illustrated by using a heated billet-receiver.

During extrusion, part of the press are subject to variable stresses due to variations in the extrusion pressures because it takes more pressure to start the flow of solid metal thru the extrusion die than is required to maintain such flow. The strain that is produced in the press by the extrusion forces required to initiate the flow of the metal diminishes as the metal begins to flow, as is particularly true when the metal being extruded is a high strain material. The resulting changes in spring action of some of the strained press parts causes changes in the rate of flow of metal thru the extrusion dies, and a corresponding variation in the uniformity of the extruded product. An object of this invention is to provide an extrusion press wherein this problem is substantially overcome. In the preferred embodiment herein described this is obtained by making the press-platens between which the extruding pressures are developed sufficiently thick so that their deflection is imperceptible, and by holding the platens by tie-rods that are pretensioned by an amount substantially greater than the separating forces to which they are subjected during extrusion, and holding the platens apart by members that have a high compressive strength and a low coefficient of compression.

It is a further object of this invention to provide a water-cooled extrusion ram wherein the extruded bar acts as a water-seal for the cooling water during the extrusion. The cooling water is first turned on a few moments after the extrusion commences and can be left on until the last billet of a group of billets has been extruded or until it is desired to change the extrusion die.

Other objects, uses, and advantages will be apparent from the following specification and drawings, in which like reference numerals indicate like parts throughout.

THE DRAWINGS

FIG. 1 is a block diagram of a system embodying this invention;

FIG. 2 is a side elevational view of an extrusion press with parts broken away;

FIG. 3 is a plan view of FIG. 2, with parts being broken away;

FIG. 4 is a fragmental cross-sectional view taken along the line 4–4 of FIG. 3;

DESCRIPTION

Figure 7:
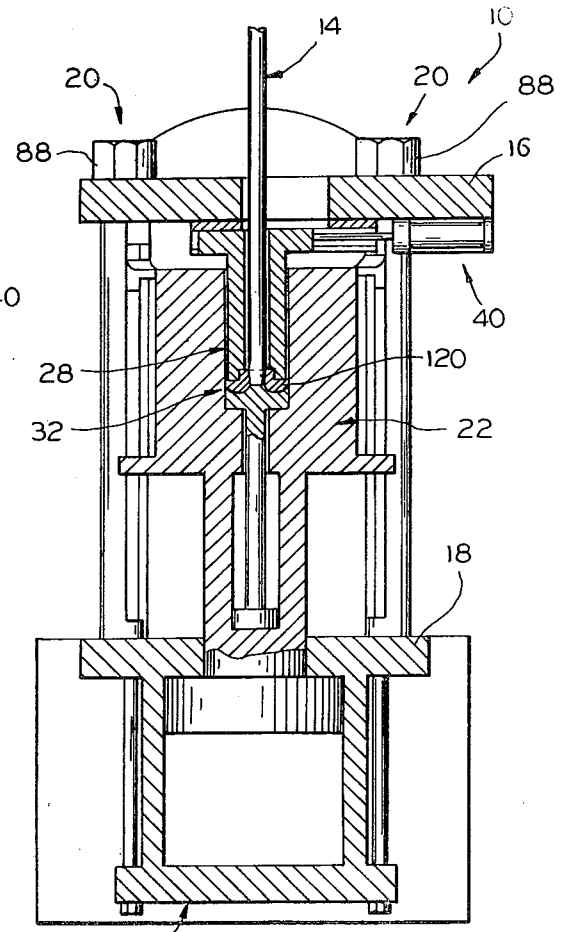
FIGS. 5 through 10 show a portion of the press of FIG. 2 in various stages in the operation thereof.

Referring to FIG. 1, a casting machine 2 includes a mold that receives molten metal for molding into a billet of the desired size and shape. The metal here involved in an alloy of approximately 90% aluminum and substantially all of the remainder magnesium. The liquid metal is caused to flow into the mold without turbulence, as is set forth in U.S. Pat. Nos. 3,228,073 or 3,331,429.

When the outside surface of the casting in the machine has first solidified the inside is still liquid. The casting mold is water cooled, so that solidification takes place as rapidly as possible, and the billets are of such size that the liquid interior of the casting is solidified quickly enough to avoid excessive grain size or crystal formation.

Billets leaving a casting machine may not be of a uniform temperature throughout because the first liquid metal entering the mold has had a longer cooling time than the last metal that entered the mold. The hot billet, as soon as it has solidified in the mold, is brought to a tempering oven 4. There its temperature drops to a uniform temperature as determined by the oven temperature. Billets from the oven 4 are transferred one at a time to an extruding press 10. The billet temperature at that time should be as high as possible but sufficiently below the eutectic temperature of the alloy of the billet that the heat generated as it passes through the extrusion die will not raise the temperature of the extruding metal at the die to the eutectic temperature.

The press has upper and lower platens 16 and 18 joined by four spacer tie rod assemblies 20. Between the platens is a billet receiver 22 that has a billet receiving chamber 24 in which a billet 12 is placed for extrusion. The receiver 22 is moved vertically by a hydraulic piston and cylinder device 26 for cooperation with a ram 28 that is secured to and depends from the upper platen 16. An extruding die 32 is mounted on the lower end 30 of the ram. The die has an extruding orifice 34 that defines the shape of the extruded product, a bar 14.

Figure 6:
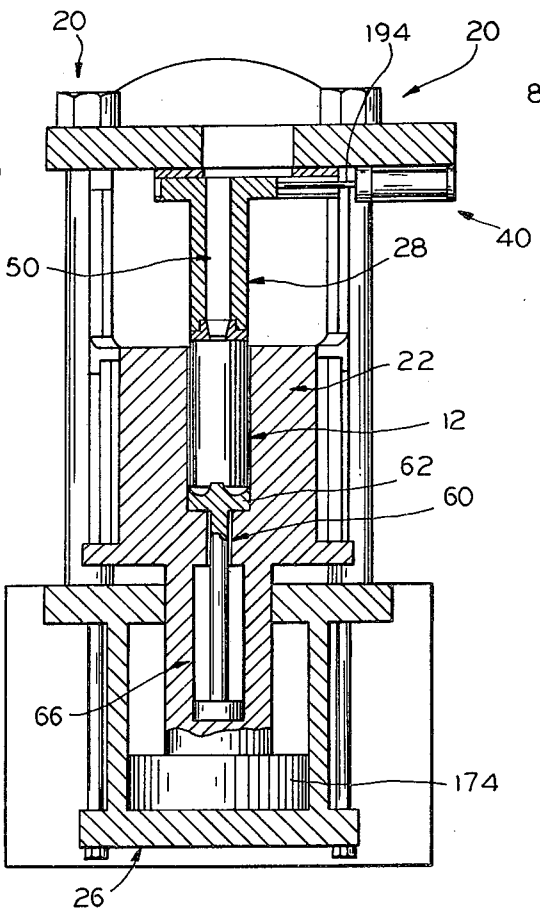

The ram 28 at its upper end 36 is mounted laterally for shifting from left to right. In the positions indicated in FIGS. 2 and 6, the ram is in axial alignment with the axis of the receiver chamber 24 to allow placing a billet 12 therein or for removing a billet patch or slug there-from. A hydraulic cylinder and piston device 40 effects the indicated lateral movement of the ram 28.

The ram included a bore 50 thru which the extruded bar moves and thru which cooling water is circulated, entering through conduit 52, and leaving through conduit 54.

A stem 60 carries a substantially cylindrical pressure head 62, the cylindrical wall which at its top makes a sliding fit with the interior wall 25 of the chamber 24 with a clearance, in one instance, of the order of 0.0075 inches. In that instance, the cylindrical wall was tapered radially inwardly from the top thereof at thus increasing the clearance between the bottom of that wall and its surrounding cylindrical surface of the receiver 25. The head 62 has a threaded shank 63 that threads into the stem 60. The stem 60 threads into a tapped bore in a piston rod 177 of a scavenging hydraulic cylinder and piston device 66 that is coaxial with and located within the device 26, to move the pressure head 62 from the retracted position of FIGS. 2 and 5 to the extended position of FIGS. 8 and 10.

The assemblies 20 are prestressed and bias the platens toward each other with a force that greatly exceeds the separating forces on the platens 16 and 18 during extrusion.

Each tie rod assembly 20 comprises a steel rod 80 extending through a cast iron sleeve 84, both ends of the rod being threaded. The lower end 82 threads into the platen 18. The upper end 86 extends through an unthreaded bore in the platen 16 and receives a tightening nut 88. Each sleeve 84 extends from platen to platen and spaces them apart by the length of the sleeve.

Each sleeve 84 is slotted as at 90 for a substantial portion of its length forming longitudinal guideways 94 in which guide lugs 92 ride. They also facilitate heating of the rods 90 during the assembly of the apparatus 10 to expand them to ease the tightening of the nuts 88.

The cross section of each pull rod 80 and the material thereof is so correlated to the cross section and the material of the sleeve that the linear compression of the sleeve, per pound exerted thereon by the tensions of the pull rods therein is minimum and small in comparison with the corresponding extension of the pull rod due to its tension.

The receiver 22 is heated by an electric heating coil 96 to maintain the billet therein at its elevated temperature during its extrusion.

The extruded bar 14 passes through an aperture 100 in the platen 15, which aperature is elongated to permit the lateral movement of the ram while it carries the bar 14 extending through the aperture 100.

The upper surface of the head 62 has an annular indentation 110 that extends from 114 along the curve 34' (FIG. 11) to the head marginal edge portion 112. It is of a depth greater than the distance between the bottom of the die 32 and the top of the receiver at the end of the extrusion stroke. The side wall of the protuberance 114 is slightly tapered to form a nonsticking taper with the metal that has last been extruded, and terminates in a circular planar top 118.

The pressure head 62 is made of a material that retains its elasticity at the temperatures and pressures to which it is subjected during extrusion. A high-speed tool steel is used, preferrably an iron-chromium-nickel alloy. The pressure exerted during extrusion acts on the top disked surface 110 of the head 62 and flexes the peripheral edge 62' into pressure engagement with the receiver wall 25, within the elastic limits of the head 62.

Figure 12:
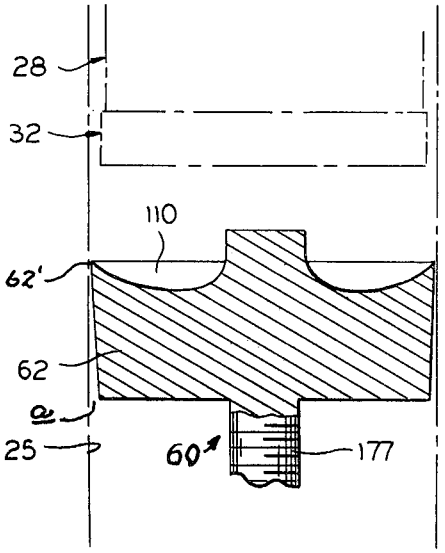
FIG. 12 is a diagrammatic enlargement of a portion of the pressure head of FIG. 11 for illustrative purposes.

The cylindrical surface of the head 62 has a slight taper as indicated at a in FIG. 12 in exaggerated form for illustrative purposes. In one actual construction of angle a was of the order of 1.5 degrees. Because this press is a backwards-extrusion press, and therefore the head 62 does not slide in the billet-chamber of the receiver during extrusion, there is no increase in the extrusion pressure required of the machine because of the high radial pressure of the top of the head 62 against the cylindrical cylinder wall of the receiver due to the aforesaid flexing of the rim 62' of the head.

Figure 8:
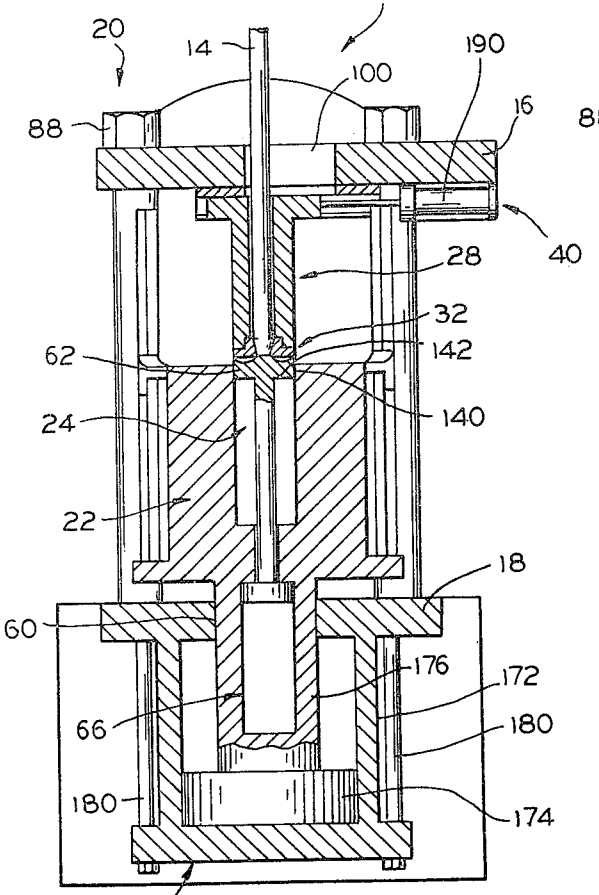
Figure 11:
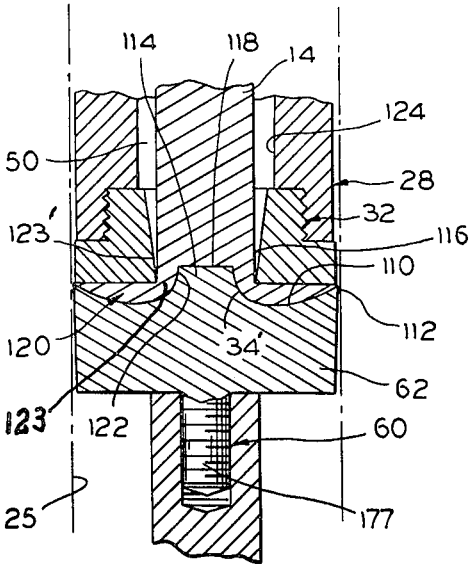
FIG. 11 is an enlarged fragmental sectional view showing the relationship of the received plunger pressure head and the extrusion die at the end of an extrusion stroke in the press of FIG. 2.

At the end of the extrusion of a billet 12, the press parts have the relationships indicated in FIGS. 8 and 11 whereby the pressure head protuberance 118 extends into the die orifice 34 forming a recess 122 in the base of the extruded metal, which recess is defined by a thin circular rim 123.

The extruded bar 14 seals the orifice 34 against water leakage therethrough. As indicated in FIG. 11, the bore 123' in the ram 28 is of larger diameter than the extrusion opening in the die 32 and the corresponding dimension of bar 14 whereby a space 50 is sufficient for the flow of cooling water. The cooling water is turned on after the extrusion has started and the first portion of the bar has passed through the die. Thereafter the water remains on.

The billet 12 in one instance was an alloy of 90 percent aluminum and 10 percent magnesium, which melts at approximately 1260 degrees F. and solidifies at approximately 1125 degrees F.; this alloy has an eutectic temperature of approximately 840 degrees F. When a billet has solidified in the casting machine and its temperature has gone below the alloy eutectic temperature, but is still above its optimum extruding temperature, it is moved into the tempering or evening furnace 4 of FIG. 1. Billets as removed from a casting machine are not of uniform temperature throughout, and it is one function of the tempering or evening furnace to bring all portions of each individual billet to the optimum temperature range. The receiver chamber 24 is preheated to a temperature that will maintain the billets placed therein at the desired temperature level. The optimum temperature is a temperature correlated to an optimum speed of extrusion to be as high as possible within the parameters of the extruder but sufficiently low for the metal to go thru complete recrystalization in its deformation as it is being extruded with a rise in temperature to bring it as near as possible but below the eutectic of that metal, say within 50° F. of that temperature.

Figure 5:
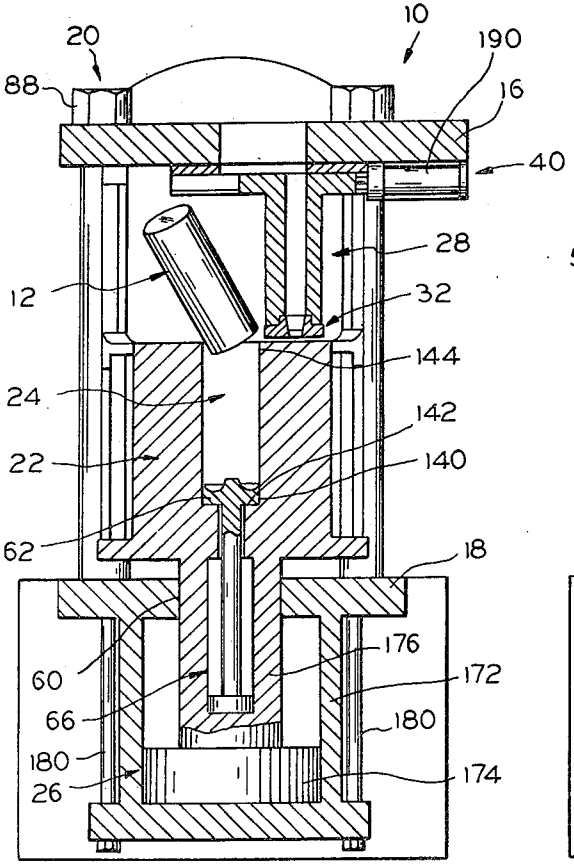
Figure 10:
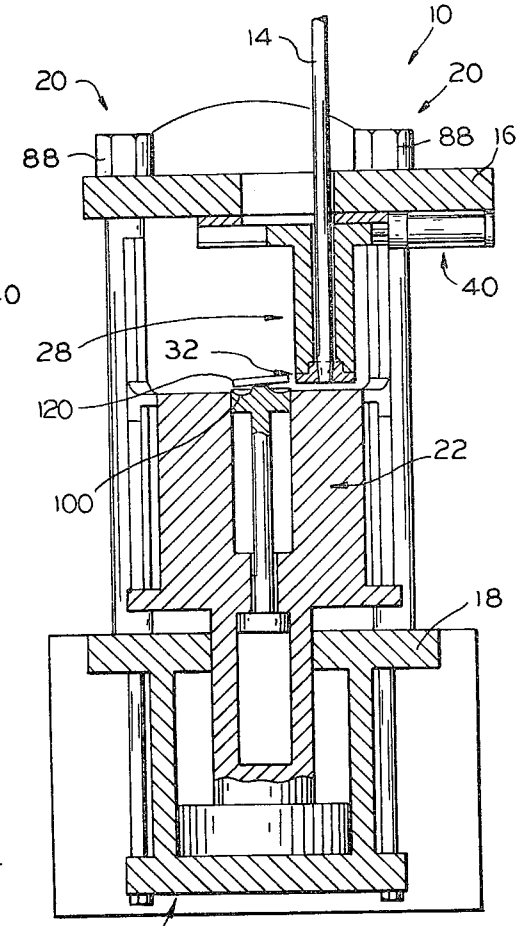

FIG. 5 shows the position of the press parts when the press is ready to receive a billet 12. The billet being placed in the receiver chamber comes to rest on top of the plunger pressure head. The hydraulic device 40 is then operated to return the ram 28 to its operating position in axial alignment with the receiver chamber shown in FIG. 6. The outside diameter of the die 32 is less than the inside diameter of the chamber 24 to provide for clearance and to provide space for all the oxides or other foreign material on the outside of the billet to remain in the machine (approximately a rough laced sleeve) as the body of the billet is extruded. The outside diameter of the ram is less than that of the die. The hydraulic device 26 may now be operated to move the receiver 24 upwardly. This first brings the top of the billet against the bottom of the die 32 (FIG. 6) and further upward movement first compresses the billet into firm contact with the cylindrical wall and base of the receiver and then extrudes the billet metal through the die (FIG. 7). The extruded metal in the die seals the die orifice against water leakage from the bottom of the chamber 50. The small clearance between the die and the surrounding wall 25 of the receiver receives the scale or other material on the cylindrical outer surface of the billet by the compression action on the billet. Additional space for this scrap is made available by making the outside diameter of the ram slightly smaller than that of the die. The being extruded bar 14 emerges through the aperture 100 of the upper platen, as indicated in FIGS. 7 and 10. Waste material such as dross is in the small space between the wall 25 of the chamber 24 and the ram that is moving inwardly of the chamber 24. When the press reaches the position of FIGS. 7 and 12, the extrusion stroke is completed. A billet patch 120 remains connected to the bottom of the extruded bar 14. The indentation 122 that is formed in the lower end of the extruded bar 14, as well as the underside contouring of the patch 120 is formed by the contour of the top of the pressure head 62. The juncture of the patch to the bottom of the bar 14 is by a thin ring 123 of a thickness which is the difference between the radius of the bar and the radius of the protuberance 114. The maximum thickness of the patch 120, due to the depth of the annular indentation 110 (FIG. 12) is greater than the distance between the bottom of the die 32 and the top of the receiver 22 when the receiver is in its lowermost position of FIGS. 8, 9, and 10. As a result, at the completion of the extrusion stroke (FIGS. 8–10) the bottom portion of the patch 120 is below the top of the receiver.

The hydraulic device 66 is then operated to maintain the plunger pressure head 62 against the billet patch 120 while the device 26 is operated to lower the receiver 22 to its retracted position. This is a change from the position of FIG. 7 to that of FIG. 8. As the receiver lowers, any dross or other metal from the billet that had been squeezed into the minute space between the outer periphery of the die 32 and the inner wall 25 of the receiver remains on the outside of the die and the ram, for later removal.

Figure 9:
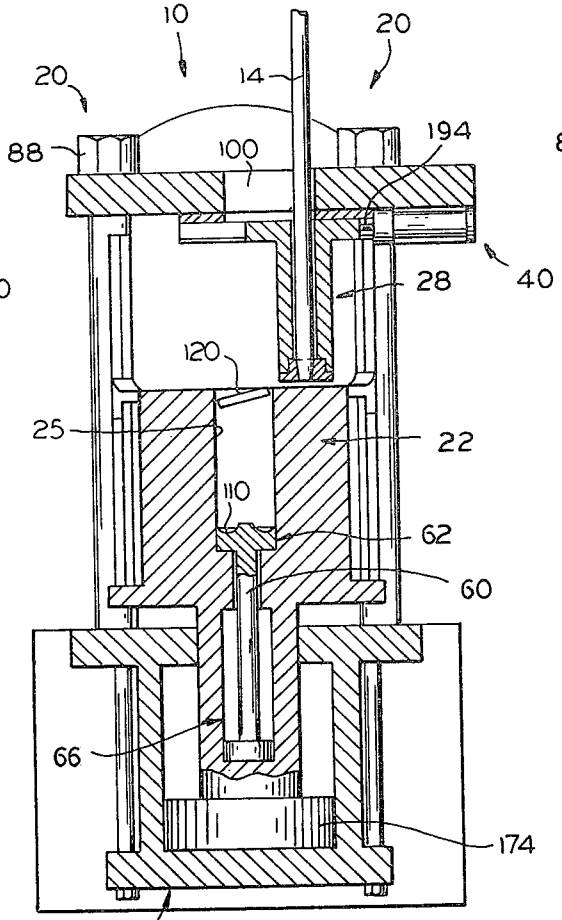

The device 66 is then operated to move the pressure head from its extended position of FIG. 8 to the position of FIG. 9. As the pressure head recedes from its upper position it leaves the patch 120 integral with the bottom of the extruded bar 14. The bottom of the patch 120 extends below the top of the receiver when the receiver reaches its lowermost position.

The ram actuating device 40 is now operated to move the ram 28 from the position of FIG. 8 to its retracted position of FIG. 9. Such movement tends to carry the patch with it. The patch comes into engagement with the top of the receiver 22 and is sheared from the bottom of the bar 14. The fact that the junction of the patch with the bottom of the bar is a thin ring 123 eases that shearing action of the patch from the bar. The lower end of the bar remains in the die and seals against the escape of the cooling liquid from the bottom of the ram. The patch 120 tends to fall, totally or partially, into the receiver chamber.

The device 66 is then operated to raise the pressure head 62 from its retracted to its extended position whereby the pressure head 62 brings the patch or slug 120 to the open end of the receiver chamber 24 if it is not already there. This material and the scrap, if any, around the ram can be then removed manually. The pressure head 62 is returned to its lowered or retracted position, by operating the device 66. The press is now in condition for receiving another billet for extrusion. In the meantime the cooling water for the ram remains "on".

Upon extrusion of the following billet, which may be immediately or even after a long time interval, the being extruded metal presses against the bottom of the previously extruded bar that is still in the die. The being extruded material pushes the previous bar ahead of it, the two being held together with a slight friction fit at the socket previously formed by the protuberance 114. When the newly extruded bar portion passes to a convenient distance above the platen 16, the previously extruded bar length can be readily removed from the following bar length.

The devices 26, 40 and 66 are supplied hydraulic pressure liquid through separate solenoid valves for separate pairs of conduit lines 160 and 162, 164 and 166, and 168 and 170, respectively.

The device 26 comprises a hydraulic cylinder 172 in which a hydraulic piston 174 reciprocates, which piston 174 carries a piston rod 176 that supports the receiver 24. The piston rod 176 has an axial cylinder base 178 in which an hydraulic piston reciprocates. The piston 179 is connected to the piston rod 177. This constitutes the hydraulic scavenging device 66.

The device 40 comprises a hydraulic cylinder 190 secured to a mounting plate 192 that is in turn secured to the upper platen 16. A piston within the cylinder 190 reciprocates a piston rod 194 that is secured to the ram 28 moving it laterally.

The ram 28 is threaded into and supported from a ram slider plate 200 that slides in a slideway 202 defined by a base plate 204 that is secured to platen 16 by bolts 206 and gib bars 208—208 secured to the base plated 204 by bolts 210. The base plate 204 has an aperture below and coextensive with the aperture 110 to make one aperture therewith to accommodate the lateral movement of the extruded bar 14 as previously described.

The receiver 22 is a cylindrical body having a bore 222, which receives a liner 224 that defines the receiver chamber 24. At the upper end, the body 220 carries a top guide plate 230 shaped to define the guide lugs 92 at the four corners of the same, that ride in the respective way 94 of the tie rod devices 20.

The receiver has a botton 250 on which the receiver body 220 and the liner 222 rest. Below this bottom is a heat barrier 252, comprising superposed steel discs, each of which is pierced to have a series of hole of a combined area of about 50% of the original area of the disc. The discs are within a cylindrical steel housing 254. The discs rest on a round adapter plate 235 which is connected to the top guide plate 230 by uniformaly spaced apart tie rods 238. The lower ends of the tie rods 238 rest on the adapter plate 235 and are threaded at 240 into tapped holes in that plate. The top guide plate 230 bears against the upper ends of the tie rods 238 and is secured thereto by set screws 242. If desired, a lower guide plate 234 may be provided which has guide lugs similar to the lugs 92, that also ride in the guideways 94, for guiding the lower end of the receiver in its vertical motion. The tie rods 238 pass through oversized holes in the lower guide plate 234.

The receiver 22 rests on the piston rod 176 and is secured thereto by a split clamping ring 262—262 that engages an annular slot in the piston rod 176 near the top 260 thereof. The clamp ring 260 is split in halves and applied from either side of the cylinder 176 and secured to the plate 235 by bolts 266.

The piston rod 177 slides thru a stuffing box 270 that has a circular flange that closes the cylindrical bore 178 and is bolted by bolts 272 to the top of the piston rod 176.

Figure 13:
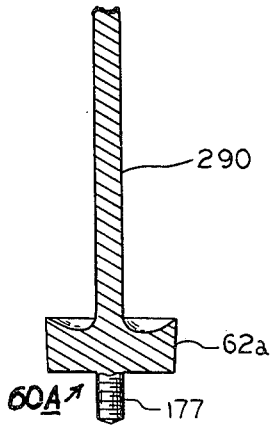
FIG. 13 is a fragmental vertical section illustrating a modified form of a part of the press of FIG. 2.

In the press illustrated in FIGS. 2–10, the extruded product is a solid rod or bar. In the modification of FIG. 13, a tubular extruded produce is made by substituting for the the plunger 60 a plunger 60*a* having a pressure head 62*a* that is cupped or recessed in the manner indicated in FIGS. 11 and 12 except that in place of the protuberance 114 the pressure head 62*a* has a cylindrical extension 290 that is proportioned to extend to above the top level of the receiver 22 and into the die opening 34 when the press is in the position of FIG. 1. The billet in this instance is made with a central axial bore for receiving the plunger extension 290. The base in the billet receiver is oversized to ease the positioning of the billet into the receiver, and surrounding the extension 290. Thereafter the initial pressure of the die 32 on the billet compresses the billet against the wall of the receiver and against the extension 290. The extension 290 is very slightly tapered to be of a smaller diameter at the top than at the bottom, to facilitate retraction of the extension 290 from the bore in an extruded tube upon completion of the extrusion of a billet. The bottom of the straight part of the extension 290 is within the die at the completion of an extrusion operation, and is of an outside diameter equal to the inside diameter of the tube being extruded.

In prior art presses, the extrusion pressure stress on the tie rod assemblies 20 stretches them to allow increase of the distance between the platens. The stress is greatest just as the metal commences to be extruded and the strain or stretch of the rods is maximum. Immediately as the extrusion continues the tie-rod stress is reduced and their elasticity causes them to return the platens towards one another. This sets up an elastic spring-like oscillation of the press which tends to cause additional flow of extrusion metal over and above the extrusion resulting from the extruding movement of the advancing hydraulic device. The metal being extruded is a high strain material. It has a peculiar characteristic in that it cannot be extruded too fast. To do so may result in faults or cracks in the extruded product. The elastic oscillation of the press parts in the prior art presses tends to cause such too rapid extrusion, in spurts. The greater rate of flow of the material through the extrusion die produces greater heat at the die, further increasing the rate of flow and increasing the risk that the material being extruded may rise to a temperature above the melting point of the eutectic, the material at the grain boundaries, with great danger of harm to the extruded product. In this invention, this condition is substantially alleviated in that the initial compression of the sleeves 84 by the tie rods 80 is of greater magnitude than the opposing forces that will be generated by the hydraulic system in the extrusion operations. The cross section area of each tie rod 80 may be such that it is stressed above its yield point, but it must be able to withstand the maximum pull exerted thereon by the operation of the hydraulic system of the press. A cross section area of each column 84 of more than 150% of its minimum requirement is preferrable in most cases, and more than 300% in many many cases. The linear compression of the cast iron by the very high tension of the rods 80 is exceedingly small. When that compression is reduced (even if it were eliminated) by the opposing force generated during the extrusion process, the resulting change in length of the cast iron sleeves 84 is negligible and the tops of the sleeves remain to all intents and purposes as stationary stops. The opposite faces of the sleeves 84 prevent movement of the platens towards one another by the pressure changes caused by commencement of extrusion. The metal will be extruded at a substantially constant rate determined by the hydraulic pressures for which the machine has been set.

Successive extruded billets produce what appears casually as one continuous length of extruded bar, but that length is in fact discontinuous at the juncture where the metal of one billet ended and that of the next billet commenced, being held together almost entirely by friction and easily separated at the juncture even during the extrusion process.

Typical of other alloys that constitute high strain material extrudable by the present process and apparatus are: alloys that are predominantly aluminum and containing silicon of the order of 10 or 12 percent, or containing copper of the order of 4 percent, or containing magnesium in quantities substantially less than 10 percent.

It is known that a hot billet is more easily extruded than a cold billet. The force required to extrude a billet that has its original heat of casting is substantially less than the force required to extrude the same billet if the cast billet is first permitted to cool and is then heated to its extrusion temperature. This same advantage can be obtained from a billet that has been cooled after casting, by reheating it to almost its eutectic temperature and maintaining it at that temperature for a time to duplicate a solution-annealed state. In one type of alloy of the above material this time is of the order of about 8 to 12 hours at about 1000° F. By using the original heat of casting of the billet the need for reheating the billet and holding it at its reheated temperature for that number of hours is obviated.

An important feature of the present invention when dealing with alloys which age harden, such as for instance the "B195" aluminum alloy, is the effect on the extruded bar of the cooling water immediately after the metal has passed through the cooling die. The immediate quenching of the extruded material at a temperature close to but below the eutectic of the material eliminates the need for a subsequent solution-annealing of the extruded bar. Each successive bar that is being extruded (except the first) depends upon the previously extruded bar to prevent cooling water from flowing out of the ram bore 50 through the die. The first bar being extruded, however, enters the ram before the cooling water has been turned on. To the extent that the first bar lacks the rapid water cooling, that bar if it is of an alloy which age hardens is to that extent not heat treated. A portion of the first bar, or all of the first bar, may be considered as "starting scrap".

The ram cylinder, the scavenging cylinder, and the receiver cylinder of the machine are controlled each by a standard four way solenoid valve operated in one direction by one electromagnetic coil and in the opposite direction by another electromagnetic coil to cause the application of pressure to the appropriate side of the moveable piston. The piston is thus moved in the appropriate one direction where it remains until moved in the opposite direction by energizing the other electromagnetic coil, as is well known in the art.

In the accompanying description we refer to the extruding operation as performed by moving the receiver with respect to the ram so that the ram die ends up in a position within the far end of the receiver. The equivalent result is obtained by moving the ram into the receiver rather than the receiver over the ram and then retracting the ram which retraction, of course, would be obtained by maintaining the head 62 in engagement with the die 32 during such retraction in the same manner that it is retained in such contact in the disclosure herein shown.

As may be seen from the above description, the rods extruded may be solid rods or hollow rods known as tubes. The external shape, of course, is determined by the shape of the die orifice.

Rods extruded in accordance with the present invention have a fine grain structure throughout. There must be a rapid cooling to solidification of the liquid metal during the casting operation to produce this fine grain in the billet from which the extrusion is to be made.

We claim:

1. Apparatus for extruding high strain rate sensitive metal, said apparatus including a first platen, a receiver for receiving a to-be-extruded metal billet, said receiver being mounted on the platen, a second platen, a ram mounted on the second platen and extending towards said receiver, said ram having means for mounting an extrusion die at one end for extruding metal from within the receiver, tie rods holding the platens against separating movement by the forces generated due to the extrusion action, said tie rods taking the thrust which is exerted due to the extrusion action, said rods being pretensioned with a tension that is greater than the forces that will be exerted on them by the aforementioned thrust, and compression columns paralleling the respective rods and constituting stops taking the thrust of the pretension of the rods and determining the spacing between the platens, characterized by the fact that the columns are of cast iron and of a cross sectional area such that their reduction in length due to the thrust exerted on them by the pretension of the tie rods is negligible so that during the extrusion action there is no more than negligible changes in the position of the stop portion of each compression column due to changes in thrust pressure exerted upon the column by the tie rods.

2. A press according to claim 1 wherein there is provided hydraulic mechanisms for actuating the press.

3. Apparatus according to claim 2 wherein each tie rod is pre-tensioned to a stress above its yield point but below its tensile strength, and each column is of a cross sectional area at least 50% greater than the minimum area required to withstand the maximum pre-tension thrust thereon by the tie rod.

4. A press according to claim 1 wherein the ram is hollow and the extruded metal passes through the die and lengthwise through the ram.

5. A press according to claim 3 having means for circulating cooling liquid through the ram to cool the extruded metal as it moves through the ram.

6. A metal extruding press having a die support and a support for a billet receiver and tie rods for holding the supports against movement of one of them away from the other by the force of the metal being extruded, the rods of the press being pre-tensioned, stop members against which the rods exert their thrust due to the pre-tension and which stop members extend substantially from one support to the other and are held in compression by said thrust, characterized by the fact that the pre-tension of the rods is greater than the maximum force that will be exerted on the rods due to the metal being extruded and the stop members are of cast iron and sized so that their linear compression by the thrust of the pre-tension of the pull rods is negligible thereby preventing significant stretching of the rods by the forces exerted thereon by the members during the extrusion and thus avoiding the effects that such stretching would have on the extrusion of the metal.

7. A structure according to claim 6 having hydraulically operated actuating means.

8. A press for extruding a billet of a high strain rate sensitive metal alloy which comprises, a die support, a support for a billet receiver, and tie-rods holding the supports against separating movement of the supports from one another by the force exerted by the metal being extruded, characterized by the fact that the press is constructed to inhibit the setting up of elastic oscillations of the press upon initiation of the extrusion flow of the high strain rate sensitive material by the tie rods being put in an initial pre-tension in an amount which is greater than the maximum force that will be exerted on the rods by the extrusion operation of the press and the tie rods are held in tension by stops against which they exert their thrust due to the pretension, which stops extend substantially from one support to the other and are compressed by said thrust, said stops being of material of an elasticity and a cross section such that their linear compression by the thrust of the pre-tension of the tie rods is negligible.

9. A press according to claim 6 wherein the die support includes a member having a base therethrough through which the extruded material is moved by the continuing extrusion of the alloy material.

10. Apparatus according to claim 6 wherein the press includes operating mechanism for moving said supports to cause the extruding action, and each column is of a cross section area between 1.5 and 3 times the minimum area required to withstand the thrust thereon of the tie rod that has been tensioned in an amount in excess of the maximum thrust that will be exerted thereon by the operation of the hydraulic mechanism.

11. A structure according to claim 6 having hydraulically operated actuating means.

* * * * *